United States Patent [19]

Yoshikawa et al.

[11] Patent Number: 4,917,001

[45] Date of Patent: Apr. 17, 1990

[54] DRIVE CONTROL VALVE FOR CONSTANT SPEED

[75] Inventors: Akihisa Yoshikawa; Kunio Watanabe; Akira Saeki, all of Soka, Japan

[73] Assignee: SMC Corporation, Tokyo, Japan

[21] Appl. No.: 257,544

[22] Filed: Oct. 14, 1988

[30] Foreign Application Priority Data

Oct. 16, 1987 [JP] Japan ..... 62-261482

[51] Int. Cl.[4] ..... F15B 11/08; F15B 13/04

[52] U.S. Cl. ..... 91/447; 91/31; 91/448

[58] Field of Search ..... 91/31, 447, 448, DIG. 2

[56] References Cited

U.S. PATENT DOCUMENTS

| | | | |
|---|---|---|---|
| 3,513,878 | 5/1970 | Smith | 91/447 X |
| 4,175,473 | 11/1979 | Iizumi | 91/447 X |

FOREIGN PATENT DOCUMENTS

| | | | |
|---|---|---|---|
| 2941342 | 4/1981 | Fed. Rep. of Germany | 91/448 |
| 3128044 | 2/1983 | Fed. Rep. of Germany | 91/447 |
| 1000616 | 3/1983 | U.S.S.R. | 91/31 |
| 1052737 | 11/1983 | U.S.S.R. | 91/448 |

OTHER PUBLICATIONS

Fluid Controls, Inc., *Hydraulic Control Valves,* 10/1984, FC-5 to 7.

Sterling Hydraulics Ltd., *Hydraulic Valves Pressure & Flow Control,* 6/1987, A.34–A.37.

*Primary Examiner*—Robert E. Garrett

*Assistant Examiner*—Thomas Denion

*Attorney, Agent, or Firm*—Oblon, Spivak, McClelland, Maier & Neustadt

[57] ABSTRACT

The drive control valve for constant speed is for driving a pneumatic actuator at a constant speed by use of a meter-out control mode, and includes a nonreturn valve for blocking discharged air from its pressure chamber and a relief valve for controlling the air pressure in the pressure chamber so as to be equal to an adjustable set pressure which is constant. When air pressure is supplied to one of the pressure chambers of the pneumatic actuator, the air pressure air discharged from the other pressure chamber is blocked by the nonreturn valve, so that it is discharged to the outside through a relief valve. In this case, however, the air pressure of the pressure chamber on the exhaust side is maintained at a set pressure for the relief valve which is set beforehand, and hence, the flow rate of air discharged from the pressure chamber becomes constant, and the pneumatic actuator is driven at a constant speed.

8 Claims, 2 Drawing Sheets

DRIVE CONTROL VALVE FOR CONSTANT SPEED

FIELD OF THE INVENTION

The present invention relates to a drive control valve for driving a pneumatic actuator at a constant speed.

DESCRIPTION OF THE PRIOR ART

The drive of a pneumatic actuator is conventionally controlled by a speed controller which is a combination of a check valve and a throttle valve. For the control, there are two types, namely, a meter-in control system which controls the flow rate on the suction side of an actuator and a meter-out control system which controls the flow rate on the exhaust side of an actuator.

In the meter-in control system, driving an actuator at a constant speed is relatively easy. However, it has in this type of control system problems exists in that it is difficult to control the driving speed of the actuator and the driving speed is likely to be effected by a fluctuation in the pressure of supplied air. In addition, a further problem exists in that the exhaust air tends to undergo an adiabatic expansion which produces dew condensation or freezing within an actuator, which may become a cause of malfunction or breakdown of equipment.

On the other hand, in meter-out control systems, air supply can be completed at an early stage due to the fact that air supply is not restricted, so that the driving speed of an actuator can be determined by exhaust capability, and hence, the speed and stroke time of the actuator can be regulated easily by changing the flow rate of exhaust. However, the internal pressure of a pressure chamber on the exhaust side of the actuator is constantly changing (decreasing gradually), and it is difficult to drive the actuator at a constant speed.

However, in meter-out control systems there are no difficulties as in the case of meter-in control systems, except for what is described in above. For this reason, it has been desired to provide for a constant speed driving of an actuator by means of meter-out control system.

SUMMARY OF THE INVENTION

In general, the flow rate of air that flows through a throttle valve is proportional to the pressure difference between the upstream and downstream sides. As a consequence, when an actuator is driven by a meter-out system with an exhaust through a throttle valve having a constant opening, the exhaust flow rate varies all the time so that it is not possible to control the flow at a constant rate. When an actuator such as an air cylinder is to be driven at a constant speed by means of a meter-out control system, it becomes necessary to maintain the exhaust flow rate at a constant level. To meet this requirement, a stabilized air movement at a constant speed can be realized by employing a variable restrictor in place of the throttle valve in the speed controller, which can feedback the pressure on the upstream side of the exhaust passage to regulate the restrictor so as to maintain a constant upstream-side pressure.

It is an object of the present invention to provide a drive control valve which enables the pressure on the upstream side of an exhaust passage to be controlled at a constant pressure by feeding back the upstream-side pressure, thereby driving a pneumatic actuator at a constant speed while enjoying the advantages of meter-out control systems.

By maintaining the constant internal pressure of the pressure chamber on the exhaust side of an actuator in this manner, and by keeping the quantity of discharged air constant, the force for accelerating the actuator can be made constant also. Therefore, a drive control at constant speed similar to that in the case of a hydraulic actuator can be realized, except for a certain period at the beginning of the operation of the actuator.

It is another object of the present invention to obtain a control valve for driving a pneumatic actuator at constant speed which can be employed in place of a conventional speed controller.

It is still another object of the present invention to obtain a drive control valve for constant speed which can to regulate a set pressure of a relief valve for controlling air flow from an outlet port to a supply/ discharge port, thereby enabling one to regulate the driving speed of the actuator.

It is still another object of the present invention to obtain a drive control valve for constant speed which enhances stopping accuracy for an actuator equipped with an intermediate stopping mechanism, by bringing the driving of the actuator to a constant speed.

In order to achieve the above objects, the drive control valve according to the present invention is provided in parallel with two valves on the passage between a supply/ discharge port of pressure fluid and an outlet port connected to a pressure chamber of a pneumatic actuator, which are a non-return valve for blocking fluid flow from the outlet port to the supply/discharge port and a valve for controlling fluid flow from the outlet port to the supply/ discharge port, and the latter valve is a relief valve which controls air pressure on the outlet-port side of the passage to be equal to a constant set valve and permits the set pressure to be adusted.

In a drive control valve for constant speed with the construction described above, if the outlet port is connected to one of pressure chambers of a pneumatic actuator and a pressure fluid is supplied to the other pressure chamber, the actuator is driven and the air in the pressure chamber on the exhaust side is discharged through the outlet port, and the exhaust air is discharged to the outside through the relief valve owing to the blockage of the fluid flow from the outlet port to the supply/discharge port by the nonreturn valve. In this case, the air pressure in the pressure chamber on the exhaust side is maintained at a previously set pressure of the relief valve, so that the pneumatic actuator can be driven at a constant speed.

The driving speed of the actuator can be regulated appropriately by controlling the set pressure of the relief valve.

DESCRIPTION OF THE INVENTION

Figure 1:
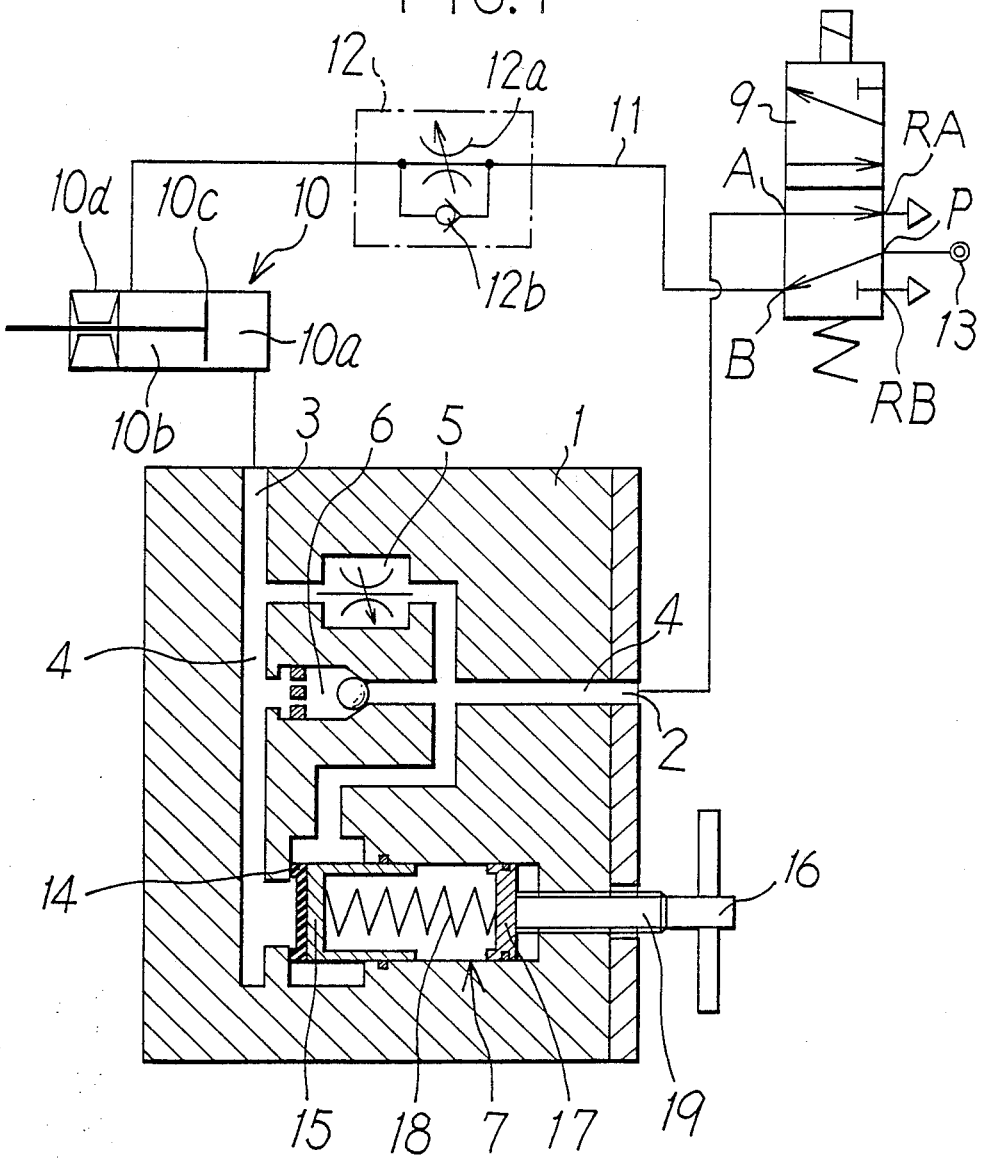
FIGS. 1 and 2 are the schematic diagrams for a first and a second embodiments of the present invention.

FIG. 1 shows a first embodiment in accordance with the present invention. A valve main body 1 of the drive control valve for constant speed has a supply/discharge port 2, an outlet port 3 of air pressure and a passage 4 which provides for the communication between the ports 2 and 3. In the passage 4, there are connected in parallel a variable restrictor 5, a nonreturn valve 6 which blocks the flow from the port 3 to the port 2 and a relief valve 7 for discharging the fluid on the outlet-port 3 side to the exterior.

In FIG. 1, a construction is shown in which a supply/discharge port 2, an outlet port 3 and a passage 4 which communicates these ports are provided in the valve main body 1, and further, a variable restrictor 5, a nonreturn valve 6 and a relief valve 7 are assembled in the valve main body 1. However, all or some of the variable restrictor 5, nonreturn valve 6 and relief valve 7 may be provided separate from the valve main body and coupled with a passage 4 formed of pipes.

This drive control valve for constant speed may be employed in place of a conventional speed controller for driving an actuator such as a pneumatic cylinder, and may be connected to a pneumatic cylinder or the like in the mode illustrated in the figure. Namely, the supply/discharge port 2 of the valve main body 1 and the outlet port 3 are communicated with a first output port A of a solenoid valve 9 and one of the pressure chambers 10*a* of the pneumatic cylinder 10, respectively, for switching driving direction of a pneumatic cylinder 10. In addition, a second output port B and the other pressure chamber 10*b* of the pneumatic cylinder 10 are connected, via a duct 11 provided with a speed controller 12 for a meter-out control system consisting of a variable restrictor 12*a* and a check valve 12*b*.

Further, in FIG. 1, 10*c* is a piston and 10*d* shows a braking device which brings the piston to a stop by gripping the piston rod. As the braking device 10*d*, the various kinds of known mechanism provided with the function that an external signal or a signal from a position detector detects a predetermined position of the piston 10*c*, and by the signal, the piston rod is gripped by means of a mechanical, electromagnetic or hydraulic force may be used.

The solenoid valve 9 comprises a five-port valve of known type, and a supply port P which comprises a source 13 of air pressure. Actuation of the solenoid 9 causes communication between the source 13 of air pressure and the first output port A, as well as communication between the second output port B and a second discharge port RB. Upon release of the solenoid excitation, the solenoid valve 9 causes the supply port P and the second output port B, and the first output port A and a first discharge port RA, to be communicated respectively.

The variable restrictor 5 provided in the valve main body 1 is for discharging the residual pressure in the outlet port 3, at the end of the stroke of the piston 10*c* in the cylinder 10. In the case that the residual pressure is to be discharged by leakage from the valve port or by some other suitable means the variable restrictor 5 may be omitted from the system accordingly. In addition, a well-known mechanism which permits adjustment of the restrictor by means of a thumbscrew may be employed for the above purpose, but a fixed restrictor may also be used instead.

The nonreturn valve 6 may be of the type with well-known structure which makes use of a ball or the like, or may be one with various structures.

On the other hand, the relief valve 7 has a valve body 15 which opens/closes a valve seat 14 from the side of the supply/discharge port 2. A pressure governing spring 18 is provided between the valve body 15 and a spring shoe 17 with a compression force which is regulated by a handle 16, and the valve body 15 is urged in the direction to close the valve seat 14 with the pressure governing spring 18. The urged force of the pressure governing spring 18, in other words, the set pressure of the relief valve 7, can be accordingly adjusted by moving the spring shoe 17, via a screw shaft 19, back and forth with respect to the valve seat 14 through turning of the handle 16 whose tip is projected out of the valve main body 1.

Here, the adjustment of the set pressure is by no means limited to the manual turning of the handle, and also may be accomplished by means of a hydraulic, mechanical, electro-magnetic or other force.

The operation of the first embodiment is as follows.

FIG. 1 illustrates the state in which the supply port P and the second output port B, and the first output port A and the first discharge port RA are communicated respectively, air pressure from the source 13 of the air pressure is supplied to the pressure chamber 10*b* of the pneumatic cylinder 10 through the duct 11 and the check valve 12*b* in the speed controller 12, and the piston 10*c* of the pneumatic cylinder 10 is moved toward the right of the figure.

During the motion of the piston toward the right, the nonreturn valve 6 blocks the flow of the air from the port 3 to the port 2 so that the air discharged from the pressure chamber 10*a* is discharged into the outside through the variable restrictor 5 or the relief valve 7, and further, through the ports A and RA of the solenoid valve 9. However, the flow rate of the air discharged from the variable restrictor 5 is set at a low level so that the air pressure on the port 3 side presses the valve body 15 of the relief valve 7 against the urged force of the pressure governing spring 18, to open the valve seat 14 and is discharged to the outside through the relief valve 7 until the pressure in the pressure chamber 10*a* reaches a set pressure of the relief valve 7 determined by the pressure governing spring 18. As a result, during the operation of the piston 10*c*, the air pressure in the pressure chamber 10*a* is always maintained at a pressure set in advance for the relief valve 7.

When the pressure chamber on the discharge side of the pneumatic cylinder 10 is kept at a constant pressure in this manner, the flow rate of the air discharged through the relief valve 7 becomes substantially proportional to the pressure in the pressure chamber 10*a* on the upstream side. The driving force acting on the piston 10*c* in the cylinder 10 therefore becomes constant, and the piston is driven at a constant speed. The operation of the piston is analogous to that of a hydraulic cylinder which uses a noncompressive fluid except at the beginning of the operation.

By varying the set pressure of the relief valve 7 as a result of adjustment of the strength of the pressure governing spring 18 by moving, via the screw shaft 19, the spring shoe 17 with respect to the valve seat 14 through turning of the handle 16 of the relief valve 7, the pressure in the pressure chamber 10*a* on the exhaust side during the driving is changed, so that it becomes possible to regulate the driving speed of the piston 10*c* in the cylinder 10.

In a cylinder with a mechanical intermediate stopping mechanism such as the braking device 10*d* which brings the pistion to a stop by gripping the piston rod, the stopping accuracy can necessarily be enhanced by making the driving speed of the piston constant.

When the piston 10*c* reaches the end of its stroke, the residual pressure in the pressure chamber 10*a* of the cylinder 10 and the duct connected to it, is discharged to the outside through the variable restrictor 5.

With the communication of the supply port P and the first output port A, and the second output port B and the second discharge port RB, by exciting the solenoid in the solenoid valve 9, the air pressure is supplied to the pressure chamber 10*a* through the nonreturn valve 6, and the air in the pressure chamber 10*b* is discharged to the outside through the variable restrictor 12*a* of the speed controller 12 in the duct 11 and the solenoid valve 9, so that the cylinder 10 is driven in the opposite direction by the meter-out control action. In this case, if the drive control valve described in the foregoing is installed in the duct 11 in place of the speed controller 12, it is possible to return the piston 10*c* at a constant speed in a manner similar to the above.

Figure 2:
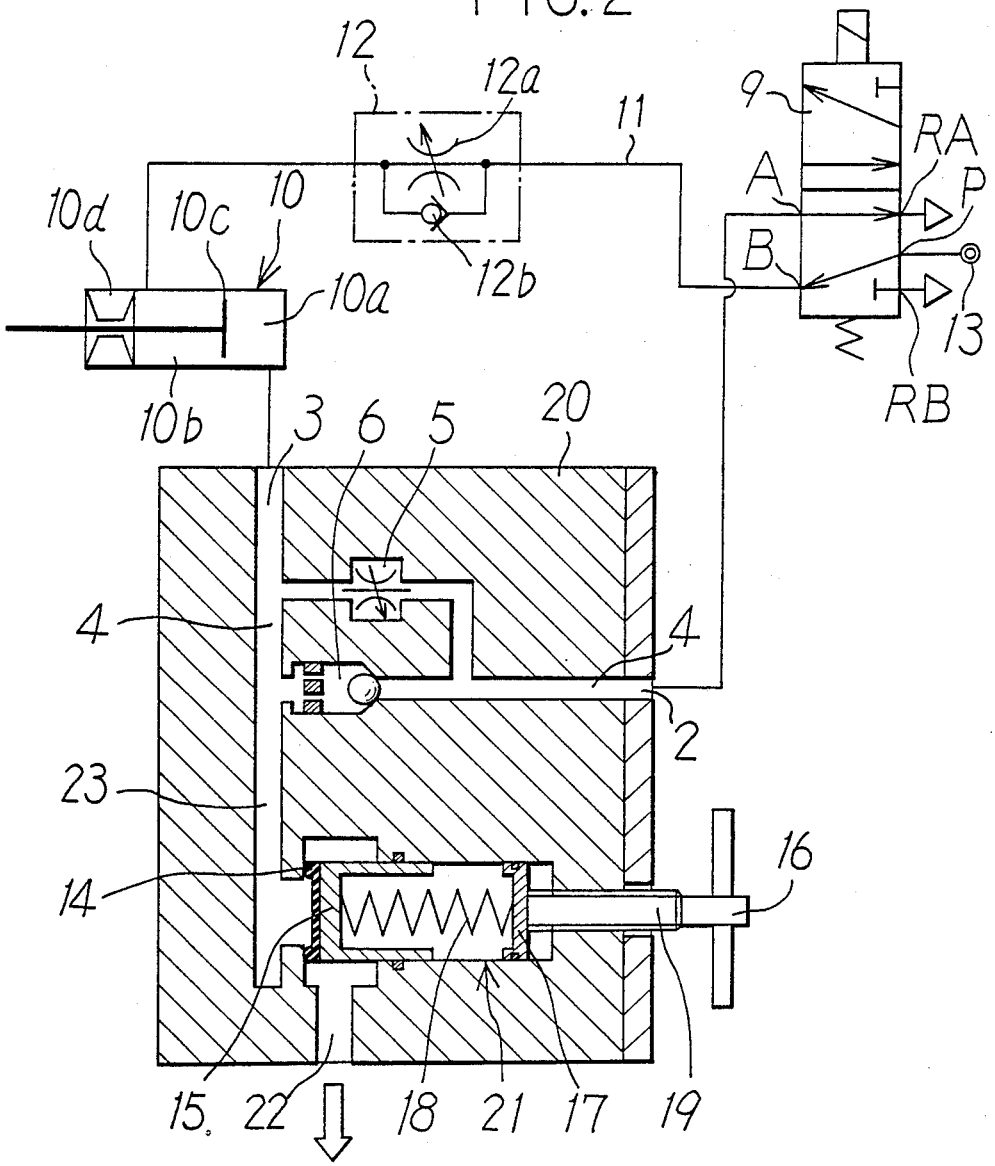

FIG. 2 shows a second embodiment of the present invention; a valve main body 20 of the second embodiment has a construction which is substantially the same as that of the first embodiment. However, in contrast to the communication between the discharge side of the relief valve 7 and the supply/discharge port 2 of the valve main body in the first embodiment, in a relief valve 21 which has a construction similar to that of the relief valve 7, there is provided an exhaust port 22, which is opened directly to the exterior. The relief valve 21 is therefore provided in a passage 23 which communicates the port 3 with the exhaust port 22.

Since the other constructions and the actions of the second embodiment are the same as those of the first embodiment except that the discharged air from the relief valve 21 is discharged to the outside directly from the exhaust port 22, identical symbols are given to the identical or corresponding ports as in FIG. 1, and detailed description is omitted.

What is claimed is:

1. A drive control valve for constant speed, which controls drive of a pneumatic actuator having a pressure chamber, comprising:

a supply/discharge port for supplying and discharging a pneumatic pressure fluid;

an outlet port connected to said pressure chamber of said actuator;

a passage having an outlet port side, said passage communicating said pneumatic pressure fluid between said supply/discharge port and said outlet port;

a nonreturn valve having means for blocking a pneumatic fluid flow from said outlet port to said supply/discharge port, said nonreturn valve being provided in said passage; and a valve having means for controlling said pneumatic fluid flow, said valve being provided in said passage in parallel with said nonreturn valve;

wherein said valve for controlling said pneumatic fluid flow comprises a relief valve having means for controlling said pneumatic fluid pressure at the outlet port side of said passage to a constant setting pressure and having means for adjusting said setting pressure;

whereby the flow rate of air discharged from said pressure chamber is constant and the pneumatic actuator is driven at a constant speed.

2. A drive control valve for constant speed as claimed in claim 1, wherein said drive control valve further comprises:

a single valve body comprising said supply/discharge port of the pneumatic pressure fluid, said outlet port, said passage communicating said ports, said nonreturn valve and said relief valve.

3. A drive control valve for constant speed as claimed in claim 2, wherein said relief valve has a discharge side, said discharge side of said relief valve having means for communicating with said supply/discharge port.

4. A drive control valve for constant speed as claimed in claim 2, wherein said relief valve comprises a discharge side, said discharge side being opened directly to the exterior of said valve body.

5. A drive control valve for constant speed as claimed in claim 1, wherein said drive control valve further comprises a restrictor provided in said passage being in parallel with said nonreturn valve and said relief valve.

6. A drive control valve for constant speed as claimed in claim 2, wherein said drive control valve further comprises a restrictor, said restrictor, said nonreturn valve, and said relief valve being provided in said passage formed in said valve body.

7. A drive control valve for constant speed as claimed in claim 1, wherein said relief valve comprises a valve member having means for opening and closing a valve seat from said supply/discharge port, and a pneumatic pressure governing spring compressedly installed between said valve member and an adjustable spring seat, wherein said pneumatic pressure governing spring comprises means for biasing said valve member toward the valve seat closing direction.

8. A drive control valve for constant speed as claimed in claim 7, wherein said relief valve further comprises a screw shaft and a handle formed on said screw shaft axis, said spring seat being movable with respect to said valve seat by means of said screw shaft through the operation of said handle, whereby the strength of the pneumatic pressure governing spring is adjustable.

* * * * *